US009773423B2

(12) United States Patent
Filias et al.

(10) Patent No.: US 9,773,423 B2
(45) Date of Patent: Sep. 26, 2017

(54) METHOD OF DETECTING AND DISPLAYING A COLLISION HAZARD FOR AN AIRCRAFT, BY GENERATING A CONSOLIDATED WARNING RELATING TO AVOIDING AN OBSTACLE BY A VERTICALLY UPWARD MANEUVER

(71) Applicant: AIRBUS HELICOPTERS, Marignane (FR)

(72) Inventors: Francois-Xavier Filias, Pelissanne (FR); Marianne Gillet, Vitrolles (FR)

(73) Assignee: Airbus Helicopters, Marignane (FR)

( * ) Notice: Subject to any disclaimer, the term of this patent is extended or adjusted under 35 U.S.C. 154(b) by 64 days.

(21) Appl. No.: 14/564,412

(22) Filed: Dec. 9, 2014

(65) Prior Publication Data

US 2015/0170527 A1 Jun. 18, 2015

(30) Foreign Application Priority Data

Dec. 16, 2013 (FR) ..... 13 02943

(51) Int. Cl.
*G08G 5/04* (2006.01)
*G08G 5/00* (2006.01)

(52) U.S. Cl.
CPC ..... *G08G 5/045* (2013.01); *G08G 5/0021* (2013.01); *G08G 5/0052* (2013.01); *G08G 5/0078* (2013.01)

(58) Field of Classification Search
None
See application file for complete search history.

(56) References Cited

U.S. PATENT DOCUMENTS 6,174,283 B1 * 1/2001 Nevo ..... A61B 5/0205 600/301
6,700,482 B2 3/2004 Ervers et al.
8,285,478 B2 10/2012 Subelet
8,306,678 B2 11/2012 Fleury et al.
8,612,132 B2 12/2013 Oberti et al.
(Continued)

FOREIGN PATENT DOCUMENTS

EP 0987562 3/2000
EP 2237126 10/2010
(Continued)

OTHER PUBLICATIONS

French Search Report for FR 1302943, dated by the French Patent Office Jun. 17, 2014, 8 Pages.

*Primary Examiner* — James M McPherson
(74) *Attorney, Agent, or Firm* — Brooks Kushman P.C.

(57) ABSTRACT

A method of generating and displaying a consolidated warning making use of collision avoidance warnings as generated by various collision avoidance systems (TCAS, HTAWS, OWS, FMS, N) fitted to an aircraft. The consolidated warning is generated in application of a selection criterion for selecting collision avoidance warnings that relate to the aircraft performing an obstacle avoidance maneuver vertically upwards. The consolidated warning is displayed in the form of a plurality of display elements comprising display elements arranged as superposed strips. A first strip indicates the presence of an obstacle to be avoided by a vertical avoidance maneuver, and a second strip that is segmented to indicate the bearing position of said obstacle relative to the aircraft.

14 Claims, 1 Drawing Sheet

(56) References Cited

U.S. PATENT DOCUMENTS

| | | | | |
|---|---|---|---|---|
| 2004/0239529 | A1 | 12/2004 | Tran | |
| 2006/0265109 | A1* | 11/2006 | Canu-Chiesa | B64D 43/00 701/3 |
| 2007/0182589 | A1 | 8/2007 | Tran | |
| 2010/0250034 | A1 | 9/2010 | Bouchard et al. | |
| 2012/0203450 | A1* | 8/2012 | Meyer | B64C 39/02 701/301 |

FOREIGN PATENT DOCUMENTS

| | | | |
|---|---|---|---|
| EP | 2450868 | | 5/2012 |
| EP | 2506105 | A2 | 10/2012 |
| EP | 2506105 | A3 | 10/2013 |
| FR | 2913800 | | 9/2008 |
| WO | 2007054481 | | 5/2007 |

* cited by examiner

METHOD OF DETECTING AND DISPLAYING A COLLISION HAZARD FOR AN AIRCRAFT, BY GENERATING A CONSOLIDATED WARNING RELATING TO AVOIDING AN OBSTACLE BY A VERTICALLY UPWARD MANEUVER

CROSS REFERENCE TO RELATED APPLICATION

This application claims priority to French patent application FR 13 02943 filed on Dec. 16, 2013, the disclosure of which is incorporated in its entirety by reference herein.

BACKGROUND OF THE INVENTION (1) Field of the Invention

The present invention relates to the field of collision avoidance systems for aircraft that generate warnings relating to obstacles that are to be avoided and that communicate those warnings in flight to a pilot of an aircraft.

The present invention relates more particularly to collision avoidance apparatus for an aircraft making use of various collision avoidance systems and also to a system for managing the warnings generated individually by the various collision avoidance systems. Such a warning management system generates a consolidated warning relating to the presence in the close environment of the aircraft of obstacles that have previously been detected by the various collision avoidance systems, and it communicates those warnings to the pilot of an aircraft, in particular by means of a visible display and/or by audible means.

(2) Description of Related Art

In the field of aviation, aircraft are fitted with collision avoidance apparatus for generating collision avoidance warnings relating to obstacles that are to be avoided and that have been detected in the close environment of the aircraft, and for displaying those warnings in flight to the pilot. Conventionally, such collision avoidance apparatus combines various collision avoidance systems associated with respective specific ways of detecting obstacles, and it includes means for communicating said collision avoidance warnings.

The various collision avoidance systems may be classified in particular depending on the obstacles that they detect, and also on the urgency and on the kinds of action the pilot needs to take on how to guide the aircraft in order to avoid the detected obstacles. One or more collision avoidance warnings indicating the presence of one or more obstacles to be avoided are communicated to the pilot by display means and/or by audible means, depending on the classification of collision avoidance systems and on the urgency of the action to be taken by the pilot in order to avoid the obstacle(s).

Conventionally, collision avoidance apparatus on board an aircraft may potentially comprise a plurality of collision avoidance systems including at least the following collision avoidance systems:

a "terrain" collision avoidance system, such as for example a helicopter terrain awareness and warning system (HTAWS);

a "perimeter" collision avoidance system, such as for example an obstacle warning system (OWS);

an "aircraft" collision avoidance system such as for example an airborne collision avoidance system (ACAS) or a traffic collision avoidance system (TCAS); and a "flight management" collision avoidance system that makes use of the resources of a flight management system on board a rotorcraft, such as for example a flight management system (FMS).

A terrain collision avoidance system is dedicated to informing the pilot about a danger of the aircraft colliding with potential obstacles that are identified and listed in a terrain database. One or more collision avoidance warnings, referred to as "terrain" warnings, are communicated to the pilot by audible means and/or by display means in the event of there being a danger of collision between the aircraft and the obstacles, with a predefined duration being taken into account. Such terrain warnings may be communicated to the pilot in particular as follows:

by visual information on a color scale, typically such as a scale of colors varying progressively towards hot colors (from green and/or amber towards red, in particular), depending on the urgency with which the pilot needs to take action in order to avoid the obstacle(s) detected by the terrain collision avoidance system; and map information locating the site of a potential collision between the aircraft and an obstacle, said map information commonly being accompanied by an indication of ground height at the collision site.

A perimeter collision avoidance system conventionally makes use of telemeter sensors commonly fitted to aircraft for detecting the presence of obstacles, if any, on the trajectory of the aircraft. The perimeter collision avoidance system is dedicated to telemeter detection in real time of the presence of obstacles, if any, in a given flight perimeter directed at least towards the front, and possibly also around the aircraft. Such obstacles include in particular obstacles on the ground and possibly also obstacles in the air, e.g. aircraft or localized weather phenomena.

The perimeter collision avoidance system generates one or more collision avoidance warnings, referred to as perimeter warnings. Perimeter warnings are communicated to the pilot by display means and by audible means, while taking account of a predetermined duration between the potential collision between the aircraft and an obstacle detected in the environment close to the trajectory being followed by the aircraft.

Perimeter warnings are displayed in particular in the form of on/off visual information in color (in particular a hot color such as red) that is displayed at a predefined threshold duration prior to collision. Perimeter warnings may also be displayed using a color scale, that varies, as mentioned above, depending on the urgency with which the pilot must take action in order to avoid the obstacle(s) detected by the perimeter collision avoidance system. Perimeter warnings are also potentially associated with visual information relating to the bearing position of the obstacle relative to the trajectory being followed by the aircraft.

An aircraft collision avoidance system supplies the pilot with one or more aircraft collision avoidance warnings relating to the movements of another aircraft nearby. Aircraft warnings are generated by the aircraft collision avoidance system on the basis of data that is exchanged between aircraft flying close to each other.

In the event of a potential collision between two aircraft, an aircraft collision warning is commonly communicated to the pilot in the form of visual information giving the position of the other aircraft. If the danger of collision persists, the visual information is accompanied by an audible message and a piloting instruction is communicated to the pilot in order to avoid a collision between the aircraft. Such a piloting instruction may potentially be an avoidance maneuver to be performed vertically upwards, vertically downwards, or less often to maintain the current trajectory of the aircraft, and it may also indicate monitoring to be performed by the pilot concerning the vertical speed of the aircraft.

A flight management collision avoidance system makes use of a flight plan previously determined by means of a flight management system on board the aircraft. The flight management collision avoidance system identifies a potential collision between an obstacle on the ground and the aircraft flying in compliance with the flight plan. The flight management collision avoidance system generates one or more collision avoidance warnings, referred to as flight-plan obstacle warnings that may be presented in the same form as terrain warnings.

The various collision avoidance systems described above are those that are most commonly used, however collision avoidance apparatus on board an aircraft may include other collision avoidance systems dedicated to detecting specific obstacles and/or to using particular ways of generating collision avoidance warnings and communicating them to the pilot.

For example, there are weather collision avoidance systems such as the weather X radar (WXR) collision avoidance systems, dedicated to detecting localized weather phenomena in the vicinity of the aircraft and displaying them.

In this context, it commonly happens that a plurality of collision avoidance warnings generated by one or more collision avoidance systems are communicated simultaneously to the pilot. However such a multiplicity of simultaneous collision avoidance warnings may potentially be the source of computation conflicts in terms of communicating them in good time, and is also a source of difficulty for the pilot who must respond quickly, generally in less than one minute, in order to avoid a collision between the aircraft and the various obstacles associated with the collision avoidance warnings that are being communicated.

Such pilot response difficulties are particularly relevant when the aircraft is a rotorcraft. A rotorcraft is an aircraft that is likely to be flying close to the ground, possibly at high speed, and/or that may be flying at low speed or that may be hovering. Such flight conditions make it necessary for the pilot to respond even more quickly in the event of a plurality of collision avoidance warnings being communicated simultaneously relating to nearby obstacles that might be numerous and varied.

Nevertheless, the collision avoidance warnings that are individually communicated by the various collision avoidance systems are useful and possibly even necessary. It is difficult to envisage reducing and/or simplifying the amount of information in the individual warnings being communicated to the pilot by each of the collision avoidance systems. That is why man/machine interfaces have been developed that enable a consolidated warning to be communicated to the pilot in addition to communicating the collision avoidance warnings generated individually by the various collision avoidance systems.

For example, man/machine interfaces have been proposed that generate and communicate a consolidated warning relating to one particular collision avoidance warning that is deduced as having the highest priority from among a plurality of collision avoidance warnings that are generated individually by various collision avoidance systems. Which collision avoidance warning has the highest priority is deduced by applying predefined selection criteria, e.g. relating to the attitude and the position of the aircraft relative to the various obstacles detected by the various collision avoidance systems.

On this topic, reference may be made to Document EP 0 987 562 (Allied Signal Inc.), which discloses such a man/machine interface that generates a warning that is consolidated on the basis of priorities between various previously-generated collision avoidance warnings.

By way of example, proposals have also been made for man/machine interfaces that generate a consolidated warning relating to detecting a group of obstacles and communicating it to the pilot. Such a group of obstacles is previously identified by applying predefined criteria, such as proximity. Such provisions are implemented in particular by a terrain collision avoidance system.

On this topic, reference may also be made to Document EP 1 946 284 (Thales SA), which discloses such a man/machine interface for generating a consolidated warning relating to detecting a group of obstacles.

With reference to FIG. 1 of the accompanying sheet of drawings, man/machine interfaces have also been proposed for rotorcraft, which generate a consolidated warning relating to various collision avoidance warnings as generated individually by a plurality of collision avoidance systems, and which communicate the consolidated warning to the pilot. The consolidated warning is communicated to the pilot by a display in the form of a table, making use of all or some of the data specific to various collision avoidance warnings generated individually by the various collision avoidance systems.

A plurality of columns are allocated respectively to the various collision avoidance systems, e.g. as in the example shown to a TCAS aircraft collision avoidance system, an HTAWS terrain collision avoidance system, an OWS perimeter collision avoidance system, and an FMS flight management collision avoidance system. Each column displays one or more rows of colors, with colors potentially varying depending on the urgency of the action that the pilot needs to take in order to avoid the obstacles, in application of a color scale that varies from an amber color to a red color, as described above.

It can be seen that research continues for integrated man/machine interfaces that generate a consolidated warning for use with collision avoidance apparatus implementing a variety of collision avoidance systems in order to provide the pilot of the aircraft with a tool for providing assistance in decision taking that gives the pilot a rapidly understandable overview of a potential emergency situation.

This research is based in particular on determining selection criteria for producing a consolidated warning that is found to be pertinent, and on determining which data to extract from the various collision avoidance warnings in order to generate the consolidated warning. Such research is also based in particular on how to communicate the consolidated warning to the pilot of the rotorcraft in ways that are ergonomically appropriate. Beyond discovering the preferences of aircraft pilots, communicating the consolidated warning in an ergonomically appropriate manner is crucial for informing the pilot quickly and effectively about the state of the aircraft relative to the outside environment and for making the pilot's task easier in terms of the obstacle avoidance maneuvers that need to be performed. The effectiveness of the man/machine interface and the behavior of the aircraft while avoiding obstacles are thus improved.

On this topic, reference may be made for example to Document U.S. Pat. No. 6,700,482 (Honeywell Int. Inc.), which proposes making use of multichannel sound communication to communicate a consolidated warning and/or an emergency collision avoidance warning to the pilot of an aircraft.

For greater understanding of the technological environment of the present invention, reference may also be made to the following documents: EP 2 506 105 (Honeywell Int. Inc.); FR 2 913 800 (Thales SA.); US 2007/182589 (My Tran); US 2004/239529 (My Tran); EP 2 237 126 (Eurocopter France); and EP 2 450 868 (Rockwell Collins France).

BRIEF SUMMARY OF THE INVENTION

The object of the present invention lies in the context of said research for incorporating a man/machine interface of the kind described above in collision avoidance apparatus that implements various collision avoidance systems, for the purpose of generating an effective and pertinent consolidated warning and communicating it to the pilot.

To this end, the present invention provides a method of making use of aircraft collision avoidance apparatus that comprises a plurality of collision avoidance systems having mutually distinct modes of operation. The collision avoidance apparatus also has a man/machine interface that generates a consolidated warning deduced at least by means of a selection operation for selecting at least one of the collision avoidance warnings generated by at least one of the collision avoidance systems, the selection being performed by the man/machine interface applying a predefined selection criterion, the man/machine interface also communicating the consolidated warning to the pilot of the aircraft at least by way of a display and possibly also by means of an audible message.

According to the present invention, data for enabling the aircraft to avoid an obstacle is incorporated in the data defining the collision avoidance warnings. Said obstacle avoidance data typically relates to a maneuver that the pilot needs to perform in order to avoid a collision between the aircraft and an obstacle detected by a collision avoidance system. By way of indication, it is conventional to perform a vertically upward avoidance maneuver, a vertically downward avoidance maneuver, or indeed an avoidance maneuver by maintaining the trajectory of the aircraft in the event of detecting a moving obstacle such as another aircraft.

By way of example, the obstacle avoidance data is incorporated in the data defining collision avoidance warnings in the manner commonly performed by collision avoidance systems and/or by the man/machine interface identifying the obstacle avoidance data depending on the typologies specified to the collision avoidance systems for which the maneuvers for avoiding obstacles detected by the aircraft are typically predefined. Such examples of ways of incorporating the obstacle avoidance data may be performed equally well in isolation or in combination.

Furthermore, and still in the present invention, said selection operation may be performed by applying a selection criterion relating to a maneuver to be performed by the aircraft to avoid the obstacle by moving vertically upwards. The man/machine interface activates at least one display element on a screen as a result of at least any one of the collision avoidance systems generating a collision avoidance warning relating to detecting an obstacle of the kind that is identified as being for avoiding by maneuvering the aircraft vertically upwards.

Whatever the obstacle avoidance maneuvers that are associated with the respective collision avoidance warnings, only those collision avoidance warnings that incorporate data for vertically upward obstacle avoidance are taken into consideration by the man/machine interface for generating the consolidated warning, with any other collision avoidance warning generated by at least any one of the collision avoidance systems being excluded from the consolidated warning.

In a preferred implementation of the method of the invention, the man/machine interface generates at least:

a first display parameter leading to on/off activation of at least one first display element of the screen, with the generation of at least one consolidated warning causing the first display element to be activated; and a second display parameter making use of bearing data relating to the bearing position of the obstacle to be avoided relative to the aircraft. The second display parameter causes at least one second display element of the screen to be activated in variable manner depending on the value of the bearing data.

In addition, the screen includes a third display element incorporating a first indicator activated by the man/machine interface depending on the value of the speed vector of the aircraft, and a second indicator activated by the man/machine interface depending on heading data of the aircraft.

The aircraft speed vector data and the aircraft heading data are data items that are conventionally supplied by the on-board instrumentation of the aircraft. Furthermore, the respective colors of the first indicator and of the second indicator are preferably different between the indicators and different relative to the colors given to the other display elements.

Preferably, each of the first, second, and third display elements comprises a strip, said strips being longitudinally oriented along the horizontal orientation of the screen and being disposed in parallel and superposed in pairs.

The orientation of the screen is as commonly seen depending on the way the screen is observed by a user, with the horizontal dimension of the screen conventionally extending from right to left of an observer of the screen. Consequently, the height dimension of the screen conventionally extends upwards perpendicularly to the horizontal dimension of the screen. Likewise, the concept of "superposition" should typically be understood along the height dimension of the screen, the first display element preferably being placed above the second display element, which is itself placed above the third display element.

In a preferred implementation of the method of the invention, the consolidated warning comprises a third display parameter incorporating urgency data relating to a period of time for pilot intervention on the guidance of the aircraft. Such urgency data is conventionally included in the data defining the collision avoidance warnings and conventionally takes account of at least one duration for pilot intervention to avoid the obstacle, possibly depending on the typology of the obstacle and/or on the distance between the obstacle and the aircraft.

Furthermore, the screen has at least two display element groups, each having a said first display element and a said second display element. The third display parameter causes said display element groups to be activated in colors that depend on the value of the urgency data, which colors are allocated thereto respectively in application of a color scale that varies depending on the value of the urgency data.

A particular arrangement of the display elements is proposed as follows:

the first display element is formed solely by a first strip. In addition, alphanumeric information may potentially be written within the first strip to specify the type of obstacle that has been detected using a predefined typology, such as a terrain obstacle or an aircraft, for example. Under such circumstances, such alphanumeric information is activated by a typology display parameter depending on typology data incorporated in the consolidated alarm and supplied by the collision avoidance systems;

the second display element is formed by a second strip that is segmented longitudinally with a predefined segmentation scale. The value of the relative bearing data causes segments making up the second strip to be activated selectively;

the third display element is formed by a third strip that is longitudinally segmented with the segmentation scale of the second strip. The position of the first indicator along the third strip varies depending on the value of the speed vector data. The position of the second indicator along the third strip varies depending on the value of the aircraft heading data.

In an implementation of the invention, the man/machine interface generates at least one fourth display parameter using data concerning margin for maneuver. The margin for maneuver data relates to the margin for the aircraft to maneuver vertically relative to the obstacle to be avoided, where such margin for maneuver data is conventionally identified by collision avoidance systems depending on a vertical separation distance between the obstacle to be avoided and the aircraft, in particular as considered from beneath its landing gear. The fourth display parameter causes at least one fourth display element of the screen to be activated in variable manner depending on the value of said margin for maneuver data.

The fourth display element is preferably arranged as a column having a distance scale indicating the altitude of the obstacle to be avoided as detected by at least one of the collision avoidance systems. The values of the distance scale are preferably marked using values that increase going upwards along the column extending along the height dimension of the screen and in particular located at a first longitudinal edge of the set of strips. The value of the margin for maneuver data causes a progressive amount of the surface area of the screen that is covered by the column to be activated.

In an implementation of the method of the invention, the man/machine interface generates at least one fifth display parameter using data relating to the distance between the aircraft and an obstacle to be avoided as detected by at least one of the collision avoidance systems. The fifth display parameter causes a fifth display element of the screen that incorporates a numerical value corresponding to the value of said distance data to be activated.

The fifth display is preferably arranged as a box placed at a second longitudinal edge of the set of strips, said numerical value being written within the perimeter of the box. Said second longitudinal edge is naturally understood as being the longitudinal edge of the set of strips that is opposite from said first longitudinal edge of the set of strips.

Where appropriate, the respective colors of at least one of the fourth and fifth display elements preferably vary to correspond with the color of the display element group activated by the man/machine interface.

BRIEF DESCRIPTION OF THE SEVERAL VIEWS OF THE DRAWINGS

An implementation of the present invention is described below with reference to FIG. 2 of the accompanying drawing sheet, in which sheet.

DETAILED DESCRIPTION OF THE INVENTION

Figure 1:
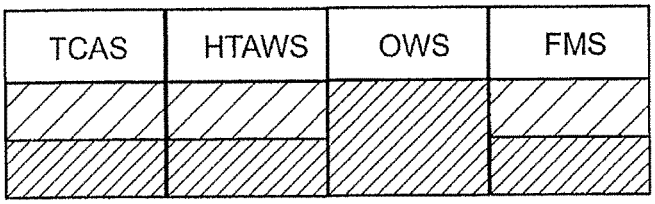
Prior Art fig.1
FIG. 1 is an illustration of ways of displaying a consolidated warning by a man/machine interface of collision avoidance apparatus for aircraft, in the prior art.
Figure 2:
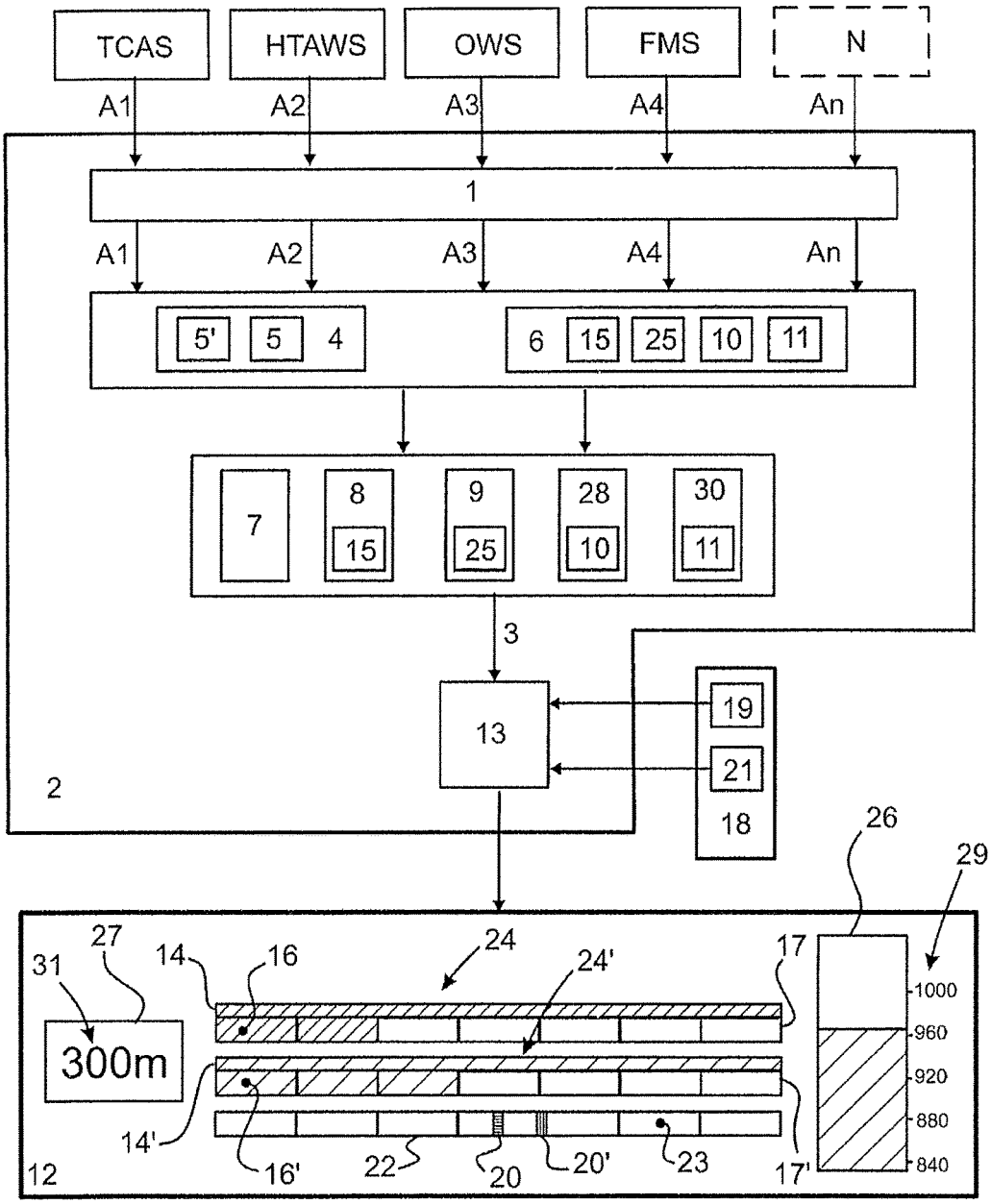
FIG. 2 is an illustration of ways of displaying a consolidated warning by a man/machine interface of collision avoidance apparatus for aircraft, in an implementation of the invention.

In FIG. 2, collision avoidance apparatus for an aircraft, in particular a rotorcraft, comprises a plurality of collision avoidance systems: TCAS; HTAWS; OWS; FMS; and N that generate collision avoidance warnings A1, A2, A3, A4, and An in the event of obstacles being detected. Each collision avoidance system has its own specific ways of detecting obstacles.

In the example shown, the collision avoidance apparatus comprises a TCAS aircraft collision avoidance system, an HTAWS terrain collision avoidance system, an OWS perimeter collision avoidance system, and an FMS flight management collision avoidance system. It should naturally be understood that the above list of collision avoidance systems potentially forming parts of the collision avoidance apparatus is given by way of example and is not exhaustive, it being possible for the collision avoidance apparatus to include one or more other collision avoidance systems as symbolized by the collision avoidance system N.

Each of the collision avoidance systems TCAS, HTAWS, OWS, FMS, and N typically generates a collision avoidance warning A1, A2, A3, A4, An in the event of detecting at least one obstacle. Each of the collision avoidance warnings A1, A2, A3, A4, and An is conventionally communicated to the pilot of the aircraft by communicating in ways that are specific to the individual ways in which the various TCAS, HTAWS, OWS, FMS, and N collision avoidance systems operate.

The collision avoidance warnings A1, A2, A3, A4, and An that might be generated by the various TCAS, HTAWS, OWS, FMS, and N collision avoidance systems are also collected during a collection operation 1 by a man/machine interface 2 that is dedicated to generating a consolidated warning 3. The consolidated warning 3 is generated by the man/machine interface 2 independently of the ways in which the collision avoidance warnings A1, A2, A3, A4, and An are individually communicated, which are specific of the operation of each of the various TCAS, HTAWS, OWS, FMS, and N collision avoidance systems.

One of the alerts individually incorporated in the collision avoidance warnings A1, A2, A3, A4, and An is an obstacle avoidance alert 5' relating to the maneuver that the pilot needs to perform quickly in order to avoid the obstacle(s) detected by the TCAS, HTAWS, OWS, FMS, and/or N collision avoidance systems.

Such a collision avoidance alert 5' is potentially generated by the TCAS, HTAWS, OWS, FMS, and N collision avoidance systems, or by default is generated by the man/machine interface 3 as a function of the typology of the TCAS, HTAWS, OWS, FMS, or N collision avoidance system that generated a given collision avoidance warning. The man/machine interface 3 performs an operation 4 of selecting one or more collision avoidance warnings A2, A3 from among the various collision avoidance warnings A1, A2, A3, A4, and An that might be generated, by applying a selection criterion 5 relating to the procedure for avoiding the obstacle(s) defined by the TCAS, HTAWS, OWS, FMS, and N collision avoidance systems.

More particularly, the man/machine interface 2 applies a selection criterion 5 relating to an obstacle avoidance maneuver performed by the aircraft moving vertically upwards, so as to retain from the various collision avoidance warnings A1, A2, A3, A4, and An that might have been collected, only those collision avoidance warnings that require the pilot to take action to cause the aircraft to be maneuvered vertically upwards, such as the collision avoidance warnings A2 and A3 that are mentioned by way of illustration.

After selecting the collision avoidance warnings A2, A3, the man/machine interface 2 selects an alert extraction operation 6 in which it extracts the alerts commonly incorporated in each of the selected collision avoidance warnings A2, A3 in order to generate the consolidated warning 3.

Various predefined display parameters 7, 8, 9, 10, and 11 are generated by the man/machine interface 2 on the basis of the alerts extracted from the alerts defining the selected collision avoidance warnings A2, A3 in order to cause a consolidated warning 3 to be displayed on a screen 12, conventionally via a graphics unit 13.

The screen 12 may potentially be a head-up display screen or a head-level display screen. A head-level display screen is preferred because it is less expensive. In addition, in the event of a head-up display screen of the aircraft malfunctioning, a head-level display screen can constitute a backup screen for displaying information relating to the flight mission and/or to the navigation of the aircraft.

More particularly, a first display parameter 7 causes on/off activation of at least one first display element 14, 14' constituted specifically as a first strip. The first strip may also include alphanumeric information relating to the type of obstacle to be avoided.

A second display parameter 8 makes use of data 15 relating to the bearing of the obstacle to be avoided relative to the aircraft in order to activate selectively certain segments such as 16 making up a second strip forming a second display element 17, 17'. Such bearing data 15 is extracted in particular from the alerts of the selected collision avoidance warnings A2, A3.

The on-board instrumentation 18 of the aircraft also supplies the graphics unit 13 with data 19 relating to the speed vector of the aircraft and data 21 relating to the heading of the aircraft in order to activate a third display element 22. The third display element 22 comprises a first indicator 20 and a second indicator 20' that move along a third strip made up of segments such as 23, with the third strip being segmented at a scale similar to the scale on which the second display element 17, 17' is segmented.

The first display element 14, 14' indicates that an obstacle avoidance maneuver needs to be performed vertically upwards. The second display element 17, 17' acts by means of its segments 16, 16' to indicate the navigation field in azimuth relative to the aircraft that contains the obstacle. The third display element 22 acts via the segments 23 to indicate the speed vector of the aircraft, which is defined by the position of the first indicator 20 along the third strip, and to indicate the position of the aircraft, which is defined by the position of the second indicator 20' along the third strip.

In the event of the aircraft suffering a failure or a loss of power, for example, the pilot is provided with assistance in decision making while ensuring the pilot continues to perceive the hazard.

It should be observed that the strips extend over the same longitudinal dimension in the horizontal dimension L of the screen 12. The size of the first strip is preferably smaller than the size of the second strip in the height dimension H of the screen 12.

Preferably, for a given group 24, 24' of display elements made up of a first display element 14, 14' and a second display element 17, 17', the first strip and the second strip are superposed one adjacent to the other, the first strip being located above the second strip. The strip of the third display element 22 is placed at the bottom of the set of strips making up one or more device element groups 24, 24', each said display element group 24, 24' comprising a first display element 14, 14' and a second display element 17, 17'. Such a layout serves to indicate the priority of a collision hazard by giving each of the groups of display elements respective colors selected from a predefined color variation scale, such as a scale of colors varying progressively from a first color towards a hotter, second color as a function of the priority of the collision hazard.

More particularly, a third display parameter 9 makes use of the value of urgency data 25 extracted from the selected collision avoidance warnings A2, A3 in order to cause one or more of said display element groups 24, 24' to be activated individually with hotter or cooler colors allocated respectively to the various display element groups 24, 24'. The value of such urgency data 25 varies in particular as a function of the length of time available to the pilot for acting on the guidance of the aircraft before colliding with the obstacle(s) specified by the consolidated warning 3.

Additionally, it is appropriate to use the man/machine interface 2 to generate a fourth display parameter 10 and a fifth display parameter 11 that serve to activate fourth and fifth display elements 26 and 27 respectively in order to inform the pilot about relative distances between the aircraft and the obstacle that is to be avoided. Nevertheless, account should be taken of the fact that the pilot must not be confused by being given too many distance indications.

The fourth display parameter 10 makes use of data 28 concerning margin for maneuvering between the aircraft and the obstacle position identified by an alert extracted from the selected collision avoidance warnings A2, A3. The margin for maneuvering relates to a vertical separation distance between the obstacle to be avoided and the aircraft. The fourth display parameter 10 causes the fourth display element 16 to be activated in a manner that varies depending on the value of the margin for maneuver data 28.

For this purpose, the fourth display element 26 is arranged as a column having a distance scale 29 indicating the altitude of the obstacle. The column is naturally oriented along the height dimension of the screen, preferably being placed at a first longitudinal edge of the set of strips of one or more of the display element groups 24, 24', as appropriate.

The value of the margin for maneuver data 28 causes the area of the screen 12 that is covered by the column to become activated progressively. The distance scale 29 enables the pilot to correct the attitude of the aircraft in good time.

The fifth display parameter 11 makes use of distance data 30 relating to the distance between the aircraft and the obstacle in order to activate the fifth display element 27 that comprises a numerical value 31 corresponding to the value of said distance data 30.

Said numerical value 31 is contained within the perimeter of a box constituting the fifth display element 27 that is located close to a second longitudinal edge of the set of strips of one or more of the display elements group 24, 24', as appropriate. Said second longitudinal edge of the set of strips is the edge opposite from the said first longitudinal edge of the set of strips.

In spite of the large amount of information displayed, the specific arrangement and the relative positions of the various display elements avoid generating a feeling of confusion with the pilot, who is in a stressful situation because of the potential for a collision between the aircraft and at least one obstacle. Such a feeling of confusion could stem from three distinct alerts being communicated associated with the position of the obstacle relative to the aircraft, respectively by the second display element 17, 17' co-operating with the third display element 20, 22, by the fourth display element 26, and by the fifth display element 27.

In addition, simultaneously communicating the relative bearing and the distance to the obstacle in the ways proposed by the present invention enables the pilot to detect a warning that might be erroneous or late. Since it is possible to use the various display element groups 24, 24' to communicate a time-varying consolidated warning 3 simultaneously with a plurality of other consolidated warnings 3, the pilot can quickly assess the pertinence of the consolidated warnings 3 being communicated depending on the consistency of the way in which the displayed information varies concerning the position of the obstacle(s) relative to the aircraft.

What is claimed is:

1. A method for an aircraft fitted with a collision avoidance apparatus having (i) a plurality of independent collision avoidance systems of different types having modes of operation that are distinct from one another and (ii) an interface in communication with the collision avoidance systems, the method comprising:

detecting obstacles in an environment of the aircraft by the collision avoidance systems;

generating collision avoidance warnings by the collision avoidance systems in response to detecting the obstacles, wherein each collision avoidance warning includes an obstacle avoidance alert for the aircraft and the obstacle avoidance alerts of at least two of the collision avoidance warnings are vertically upward obstacle avoidance alerts;

receiving by the interface the collision avoidance warnings;

selecting by the interface the at least two of the collision avoidance warnings for use in generating a consolidated warning:

wherein the step of selecting by the interface the at least two of the collision avoidance warnings is performed by the interface applying a selection criterion relating to a vertically upward obstacle avoidance maneuver, with only those collision avoidance warnings that include a vertically upward obstacle avoidance alert being selected by the interface for use in generating the consolidated warning; any other collision avoidance warning not being selected by the interface;

generating by the interface the consolidated warning using the at least two of the collision avoidance warnings, any other collision avoidance warning being excluded from being used in generating the consolidated warning: and communicating by the interface the consolidated warning to a pilot of the aircraft via at least a display.

2. The method according to claim 1, wherein the obstacle avoidance alert for the aircraft included in each collision avoidance warning is provided by the collision avoidance systems and/or by the interface identifying the obstacle avoidance alert in compliance with typologies specific to the collision avoidance systems.

3. The method according to claim 1, wherein:

the interface generates at least:

a first display parameter leading to on/off activation of at least one first display element of a screen of the display, with the generating of the consolidated warning causing the first display element to be activated; and a second display parameter making use of bearing data relating to a bearing position of an obstacle to be avoided relative to the aircraft, the second display parameter causing at least one second display element of the screen to be activated in variable manner depending on the value of the bearing data; and the screen includes a third display element incorporating a first indicator activated by the interface depending on a value of a speed vector of the aircraft, and a second indicator activated by the interface depending on heading data of the aircraft.

4. The method according to claim 3, wherein each of the first, second, and third display elements comprises a strip, the strips being longitudinally oriented along a horizontal orientation of the screen and being disposed in parallel and superposed in pairs.

5. The method according to claim 3, wherein:

the interface generates a third display parameter making use of urgency data relating to a time period for pilot intervention on the guidance of the aircraft; and the screen includes at least two display element groups, each having a first display element and a second display element, the third display parameter causing the at least two display element groups to be activated in colors that depend on a value of the urgency data, which colors are allocated thereto respectively in application of a color scale that varies depending on the value of the urgency data.

6. The method according to claim 3, wherein:

the first display element is formed solely by a first strip;

the second display element is formed by a second strip that is segmented longitudinally with a predefined segmentation scale, a value of a relative bearing data causing segments making up the second strip to be activated selectively; and the third display element is formed by a third strip that is longitudinally segmented with a segmentation scale of the second strip, a position of the first indicator along the third strip varying depending on a value of speed vector data and a position of the second indicator along the third strip varying depending on a value of aircraft heading data.

7. The method according to claim 1, wherein the interface generates at least one fourth display parameter making use of data relating to margin for maneuver concerning a vertical separation distance between an obstacle to be avoided, and the aircraft, the fourth display parameter causing at least one fourth display element of a screen of the display to be activated in variable manner depending on a value of the margin for maneuver data.

8. The method according to claim 7, wherein the fourth display element is arranged as a column having a distance scale indicating an altitude of an obstacle to be avoided, as detected by at least one of the collision avoidance systems, the column being oriented along a height dimension of a screen of the display and being placed at a first longitudinal edge of a set of strips, the value of the margin for maneuver data causing a surface area of the screen covered by the column to be activated progressively.

9. The method according to claim 8, wherein the interface generates at least one fifth display parameter using data relating to a distance between the aircraft and an obstacle to be avoided as detected by at least one of the collision avoidance systems, the fifth display parameter causing a fifth display element of a screen of the display that incorporates a numerical value corresponding to a value of the distance data to be activated.

10. The method according to claim 9, wherein the fifth display element is arranged as a box placed at a second longitudinal edge of the set of strips, the numerical value being written within a perimeter of the box.

11. The method according to claim 9, wherein respective colors of at least one of the fourth and fifth display elements vary.

12. The method according to claim 1, wherein the collision avoidance systems include collision avoidance systems selected from a group including at least a terrain collision avoidance system, a helicopter terrain awareness and warning system (HTAWS), a perimeter collision avoidance system in a form of an obstacle warning system (OWS), an airborne collision avoidance system (ACAS), a traffic collision avoidance system (TCAS), and a flight management collision avoidance system (FMS).

13. A collision avoidance apparatus for an aircraft, the collision avoidance apparatus comprising:

a plurality of independent collision avoidance systems of different types having modes of operation that are distinct from one another, the collision avoidance systems to detect obstacles in an environment of the aircraft and to generate collision avoidance warnings in response to detected obstacles, wherein each collision avoidance warning includes an obstacle avoidance alert for the aircraft and the obstacle avoidance alerts of at least two of the collision avoidance warnings generated by the collision avoidance systems are vertically upward obstacle avoidance alerts;

an interface in communication with the collision avoidance systems, the interface to receive the collision avoidance warnings, select the at least two of the collision avoidance warnings for use in generating a consolidated warning, generate the consolidated warning based on the at least two of the collision avoidance warnings, and communicate the consolidated warning to a pilot of the aircraft via at least a display; and wherein the interface performs the selection of the at least two of the collision avoidance warnings by applying a predefined selection criterion relating to a vertically upward obstacle avoidance maneuver with only those collision avoidance warnings that include a vertically upward obstacle avoidance alert being selected by the interface for use in generating the consolidated warning and any other collision avoidance warnings being excluded from being used in generating the consolidated warning.

14. The collision avoidance apparatus according to claim 13, wherein the collision avoidance systems include collision avoidance systems selected from a group including at least a terrain collision avoidance system, a helicopter terrain awareness and warning system (HTAWS), a perimeter collision avoidance system in a form of an obstacle warning system (OWS), an airborne collision avoidance system (ACAS), a traffic collision avoidance system (TCAS), and a flight management collision avoidance system (FMS).

* * * * *